US005219029A

United States Patent [19]

Behrends

[11] Patent Number: 5,219,029

[45] Date of Patent: Jun. 15, 1993

[54] OSCILLATOR FOR CONTINUOUS CASTING MOLD

[76] Inventor: Gunther Behrends, 1 Birchcrest Ave., Danbury, Conn. 06811

[21] Appl. No.: 848,590

[22] Filed: Mar. 9, 1992

[51] Int. Cl.[5] ..... B22D 11/04

[52] U.S. Cl. ..... 164/416

[58] Field of Search ..... 164/260, 416, 478

[56] References Cited

U.S. PATENT DOCUMENTS

| | | | |
|---|---|---|---|
| 2,818,616 | 1/1958 | Rossi . | |
| 2,871,530 | 2/1959 | Wieland . | |
| 2,946,100 | 7/1960 | Baier et al. . | |
| 2,947,075 | 8/1960 | Schneckenburger et al. . | |
| 3,148,420 | 9/1964 | Hess . | |
| 3,200,456 | 8/1965 | Harter, Jr. et al. | 22/200.1 |
| 3,253,473 | 5/1966 | Chisholm | 74/96 |
| 3,258,815 | 7/1966 | Reinfeld et al. . | |
| 3,292,215 | 12/1966 | Taylor et al. | 164/416 |
| 3,318,006 | 4/1967 | Barbe et al. | 22/57.2 |
| 3,343,592 | 9/1967 | Vogel . | |
| 3,395,751 | 7/1968 | Hess . | |
| 3,409,070 | 11/1968 | Ciochetto | 164/261 |
| 3,528,482 | 9/1970 | Fastert . | |
| 3,581,806 | 6/1971 | Neumann | 164/260 |
| 3,592,258 | 7/1971 | Simmons | 164/260 |
| 3,638,714 | 2/1972 | Newhall et al. | 164/83 |
| 3,659,643 | 5/1972 | Pauels | 164/260 |
| 3,664,409 | 5/1972 | Kolomeitsev et al. | 164/260 |
| 3,724,529 | 4/1973 | Chaulet et al. | 164/154 |
| 3,782,679 | 1/1974 | Ward | 249/170 |
| 3,822,738 | 7/1974 | Rotarides et al. | 164/260 |
| 4,195,684 | 4/1980 | Tsuchida | 164/416 |
| 4,456,052 | 6/1984 | Kawakami | 164/416 |
| 4,480,678 | 11/1984 | Cazaux et al. | 164/416 |
| 4,529,031 | 7/1985 | Scheinecker et al. | 164/478 |
| 4,577,277 | 5/1986 | Kamei et al. | 364/472 |
| 4,765,392 | 8/1988 | Vatant | 164/416 |
| 4,883,114 | 11/1989 | Wolf | 164/478 |

FOREIGN PATENT DOCUMENTS

| | | | |
|---|---|---|---|
| 3000117 | 7/1981 | Fed. Rep. of Germany . | |
| 1221530 | 2/1971 | United Kingdom | 164/416 |

*Primary Examiner*—Richard K. Seidel
*Assistant Examiner*—Erik R. Puknys
*Attorney, Agent, or Firm*—Rogers & Scott

[57] ABSTRACT

A mold oscillator for a continuous casting machine comprises at least two tensile elements disposed so as to always remain in tension. The tensile elements lie on respective radii extending from the radius of curvature of the casting radius and are anchored to a fixed external frame. The oscillating drive is in the form of a cam which moves the follower pivoted at one end. A transfer element between the follower and the mold transmits the oscillation to the mold and the oscillation stroke is varied by means changing the distance of the cam from the pivoted end of the follower.

9 Claims, 5 Drawing Sheets

OSCILLATOR FOR CONTINUOUS CASTING MOLD

FIELD OF THE INVENTION

This invention relates to an oscillator used in continuous casting to move the water cooled mold to and fro relative to the solidifying casting to prevent the casting from sticking to the mold and causing surface defects in the cast product. More particularly, the invention relates to a continuous casting machine in which the cast product is guided out of the mold in a curved path having a predetermined casting radius so that the cast product may be withdrawn and trimmed to required lengths in a horizontal orientation. The oscillator according to the invention comprises both means to oscillate the mold and means to guide the mold along a curved path.

BACKGROUND OF THE INVENTION

In the past, molds were mounted on a beam having a length corresponding to the radius of curvature and pivoted at the centre of curvature. The mold was mounted on the other end of the beam and moved with the beam during oscillation. The rather long beam length involved and many mechanical difficulties encountered with changes in beam length, fatigue, and load on the bearings were found to be impractical.

The aforementioned problems were at least parts addressed by the adoption of short levers provided in pairs and connecting the mold to an external support disposed between the mold and the centre of curvature. The short levers were inclined relative to each other and aligned to the centre of the casting arc. This improvement in the art is well described in U.S. Pat. No. 3,343,592 to Vogel. Because the reciprocating movement of the mold is very short (0.050 to 0.5 in) the deviation of the short lever travel from the casting arc is very small and the mold movement along the casting radius is acceptable. However, the pin joints of this design introduce some undesirable clearances which have to be carefully controlled to make the method practical. The operating conditions of a casting plant, including extremely high temperatures, moisture, and abrasive substances in the atmosphere make the oscillator highly maintenance intensive.

In U.S. Pat. No. 4,456,052 to Takashi Kawakami, the short lever design is improved by introducing a hydraulic cylinder which compensates for bearing clearances.

The present tendency is to increase the frequency of continuous casting molds and permit frequencies of up to 400 cylces per minute. This requirement has lead to completely new designs using a multitude of eccentrics as in U.S. Pat. No. 4,480,678 to Cazaux et al. While this is an improvement, it is a high cost mechanically complex apparatus requiring carefully controlled maintenance. Some proposals have been made to use leaf springs in this field, as in U.S. Pat. No. 3,664,409 to Kolomeitsev et al and DE 3 000 117 to Sack, these springs are disposed in a manner which subjects them to both compressive and tensile forces. They are thus limited in their application to situations where the buckling load of the leaf spring cannot be exceeded and thus are of limited use.

The object of this invention is to address the aforementioned problems described with reference to the prior art, namely to simplify the construction of the mold oscillator and to produce a high frequency oscillation which is stable and maintenance free.

SUMMARY OF THE INVENTION

In accordance with one aspect of this invention, there is provided an improved mold guidance means forming part of a continuous casting machine in which a chilled mold is oscillated in a curved path corresponding to a predetermined casting radius. The mold is guided by a first tensile element having an inner end and an outer end, the outer end being anchored to a fixed external frame and the inner end being secure to move with the mold, the first tensile element lying on a first radius extending from the centre of curvature of the predetermined casting radius. A second tensile element having an inner and an outer end both anchored to a fixed external frame is secured to move with the mold at a point intermediate the inner and outer ends. At least one end of the second tensile element has variable tensioning means adapted to apply a tensile force to the element so as to prestress the element prior to oscillation. The second tensile element lies in a second radius extending from the centre curvature of the predetermined casting radius.

In accordance with another aspect of this invention, the oscillating drive comprises drive means, cam means coupled to the drive means for rotation in a vertical plane and having a predetermined eccentricity, follower means pivotable at one end about a pivot mounted to a fixed external frame and adapted to maintain physical contact with the cam means, transfer means disposed to maintain contact between the follower means and the mold table, and selection means adapted to adjust the distance separating the wheel from the pivoted end of the follower so as to vary the oscillation stroke imparted to the mold.

BRIEF DESCRIPTION OF THE DRAWINGS

A preferred embodiment of the invention is described below with reference to the accompanying drawings, in which.

DETAILED DESCRIPTION OF A PREFERRED EMBODIMENT OF THE INVENTION WITH REFERENCE TO THE DRAWINGS

Figure 1:
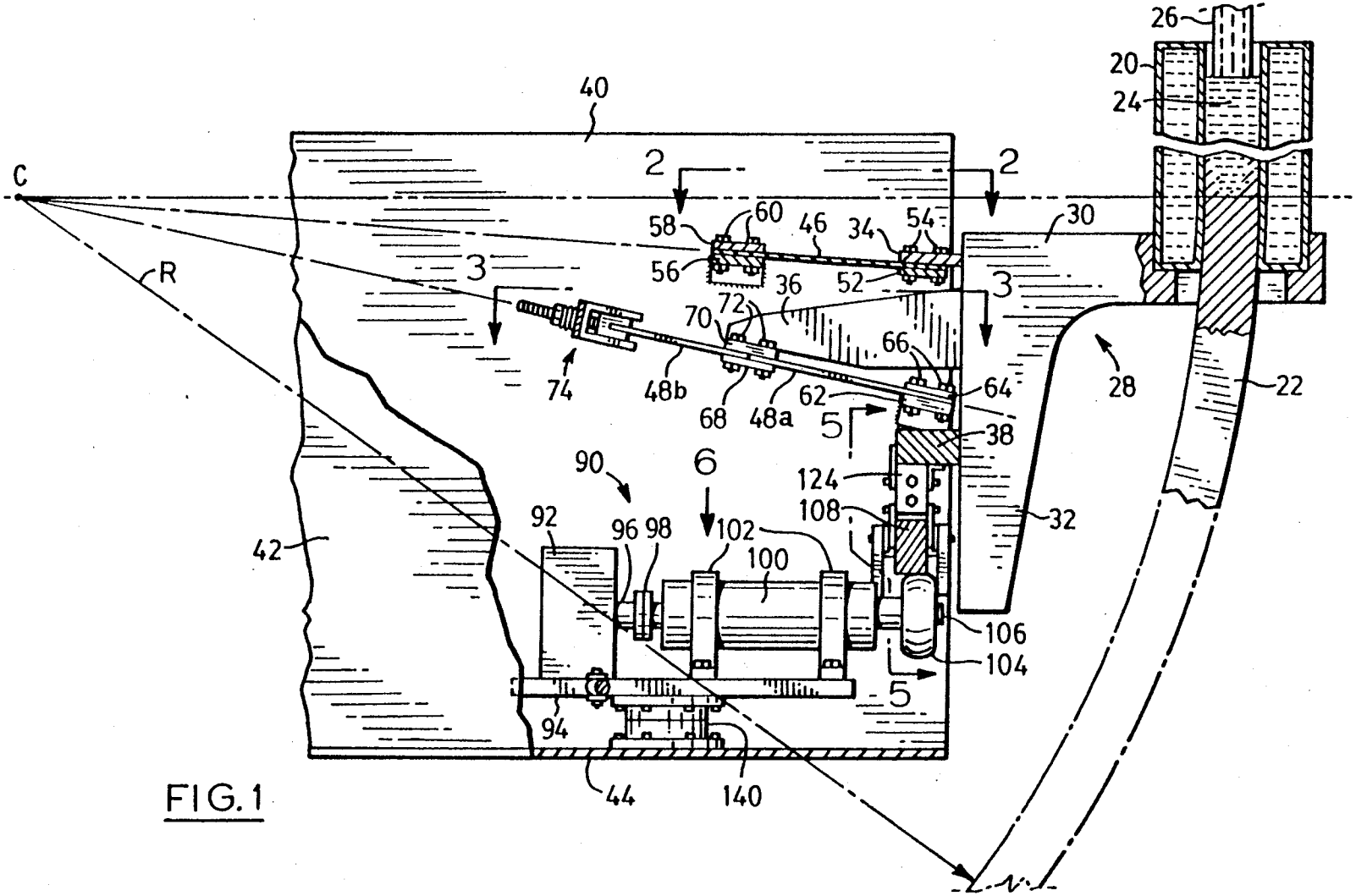
FIG. 1 is a partly sectioned side elevation of a continuous casting machine made according to the invention.

Referring firstly to FIG. 1, there is shown a continuous casting machine comprising a water cooled mold 20 of which the inner walls have a slight curvature as is now common in the art so as to precurve a cast bar 22 emerging from the mold 20 at the bottom thereof and being continuously supplied from a pool of mold metal 24 contained at the top of the mold and fed by a tundish 26 or other conventional means. The cast bar 22 is guided along a predetermined curved path by conventional means including starter bars and rollers (not shown), the path having an inner radius of curvature designated by the letter R and having a centre of curvature C.

The mold 20 is supported on a mold table generally indicated by numeral 28 and comprising a generally horizontal platform 30, a downwardly extending leg portion 32, a lug 34 extending across the width of the platform 30 transversely to the downward portion 32 and a pair of extensions 36 extending transversely to the downward portion 32 and disposed below the lug 34. The extensions 36 are spaced from one another in parallel and disposed on the same side of the mold table 28. A bracket 38 extends outwardly from the downward portion 32 and is disposed below the extensions 36.

Figure 3:
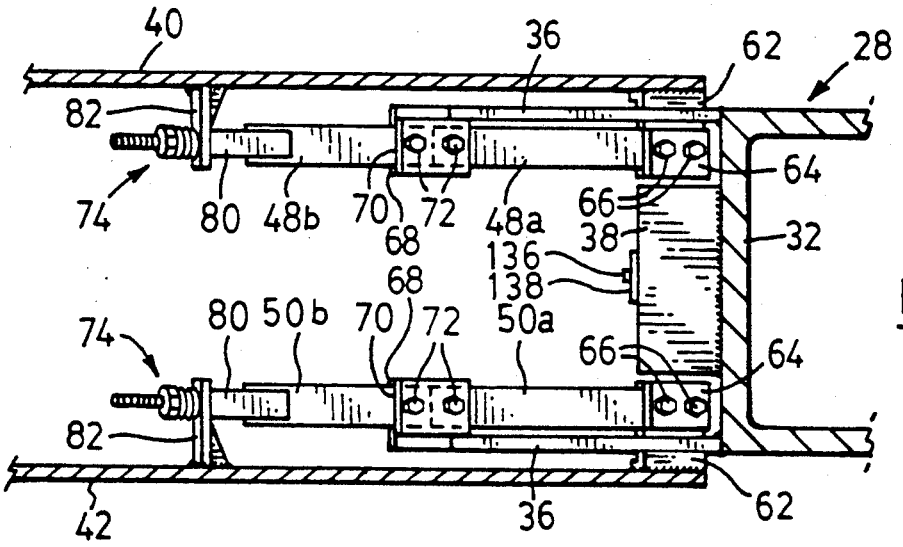
FIG. 3 is a plan view looking down on line 3—3 of FIG. 1 (drawn to a larger scale)

An oscillating drive and mold guidance means is housed in a fixed external frame having a rear wall 40 as drawn in FIG. 1, a partly cutaway front wall 42 and a floor 44. The mold 20 and associated mold table 28 are connected to the frame by tensile elements 46, 48*a*, 48*b* and 50*a*, 50*b* (FIG. 3) anchored at their free end to the fixed frame and each lying in a respective radius extending from the centre of curvature C.

Figure 2:
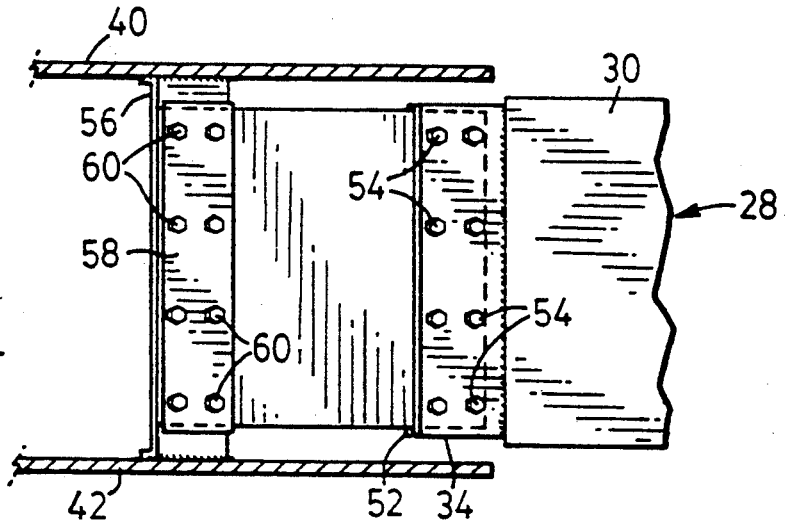
FIG. 2 is a plan view looking down on line 2—2 of FIG. 1 (drawn to a larger scale)

The first tensile element 46 has its inner end sandwiched between the lug 34 and a plate 52 and is secured with suitable fasteners 54. The outer end of the first tensile element 46 is similarily sandwiched between a bracket 56 extending between the rear wall 40 and the front wall 42 of the fixed frame and a plate 58 likewise secured by suitable fasteners 60. As can more clearly be seen in FIG. 2, the first element 46 comprises a sheet of rectangular shape which extends substantially across the width of the platform 30 comprising the mold table 28. Preferably, it is constructed from stainless spring steel material which is precipitation hardened.

The second tensile element 48 comprises two lengths 48*a* and 48*b* of stainless spring steel, each having an end anchored to the fixed external frame and of which the other end is attached to a common mount at the free end of one of the extensions 36. Conveniently, the lengths may be deemed to comprise a single tensile element of which both the inner and outer ends are anchored to the fixed external frame. Thus the length 48*a* of the second tensile element has one end sandwiched between a bracket 62 extending transversely from the rear wall 40 toward the front wall 42 and a plate 64 secured by suitable fasteners 66. The other end of the length of 48*a* comprising the second tensile element 48 is secured to move with the mold 20 and is sandwiched between a lug 68 forming part of the extension 36 and a plate 70 secured by a suitable fastener 72. The length 48*b* comprising the other end of the second tensile element 48 is likewise secured to the mold extension 36 by a respective fastener 72 transversing the plate 70 and lug 68. At the other end, the length 48*b* is secured to variable tensioning means generally indicated by numeral 74 anchored to the rear wall 40 of the fixed external frame.

Figure 4:
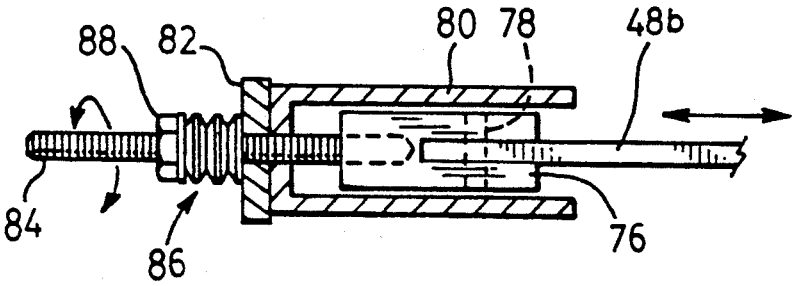
FIG. 4 is an enlarged detail view of variable tensioning means.

The variable tensioning means 74 is shown in greater detail in FIG. 4. The second element 48 is held in a shackle 76 by a through pin 78 shown in ghost-outline. The shackle 76 is disposed inside a guide 80 of substantially C-shaped cross section and secured to a bracket 82 extending from the rear wall 40 of the external frame towards the front wall 42. A threaded rod 84 is received in an opening provided through the bracket 82 and guide 80 and is held captive in the shackle 76. A plurality of Belville spring washers 86 located about the rod 84 and interposed between the bracket 82 and an adjustment nut 88 operate to apply a load on the shackle 76 and prestress the second tensile element 48. The tension imparted to the length 48*b* of the second tensile element 48 may be adjusted as required by varying the position of the retaining nut 88 on the rod 84.

As indicated above, the mold extension 36 is provided in pairs each associated with a respective second tensile element 48, 50. The attachment of the second tensile element 50 to the fixed external frame and to the mold table 28 is analogous to the attachment of the second tensile element 48 and like parts are identified by like numerals in the drawings. It will of course be understood that the brackets 62 and 82 associated with the second tensile element 50 extend from the front wall 42 toward the rear wall 40 of the fixed external frame.

Figure 5:
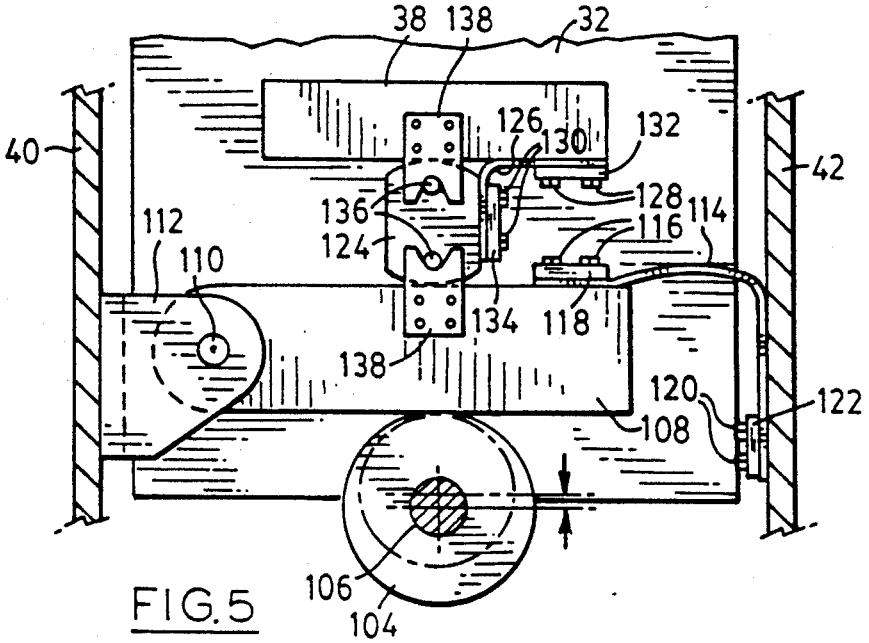
FIG. 5 is a side elevational view taken on line 5—5 of FIG. 1 (drawn to a larger scale)
Figure 6:
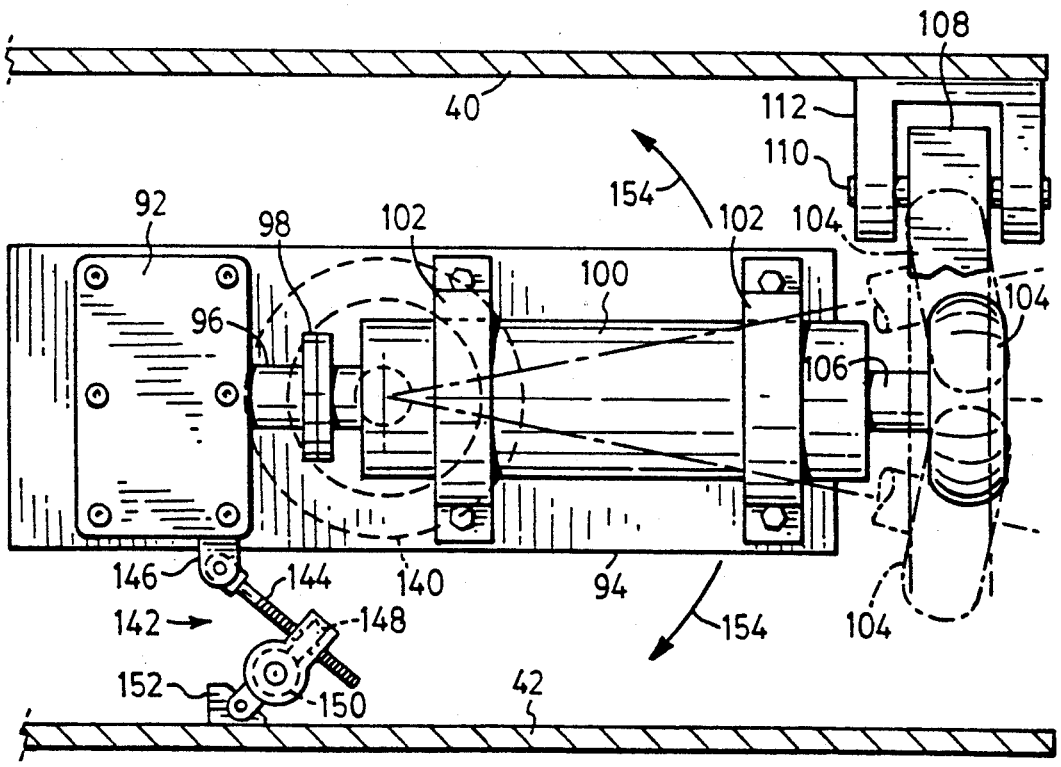
FIG. 6 is a top elevational view on arrow 6 from FIG. 1 (drawn to a larger scale)

The oscillating drive generally indicated by numeral 90 in FIG. 1 will now be described with reference being made in particular to FIGS. 5 and 6. The oscillating drive comprises drive means including a motor (not shown) mounted in a housing 92 and supported on a table 94, a drive shaft 96 driven by the motor, and a coupling 98 coupling the drive shaft 96 to a reinforced shaft 100. The gear box 100 is supported on the table 94 by a pair of longitudinally spaced pedestals 102. An eccentrically driven wheel or cam 104 is rotatably driven for rotation in a vertical plane with a driven shaft 106 coupled to the shaft 100. A follower 108 in the form of a bar is pivotably mounted at one end for rotation about a pivot pin 110 fixed to a bracket 112 extending from the rear wall 40 of the fixed external frame toward the front wall 42. A leaf spring 114 is secured to the free end of the follower 108 remote from the pivot 110 by means of suitable fasteners 116 which penetrate the leaf spring and an overlying plate 118. The leaf spring 114 is also secured to the front wall 42 of the fixed external frame with fasteners 120 which penetrate the leaf spring and an overlying plate 122. The leaf spring 114 thus biases the follower 108 toward the wheel 104.

A transfer means 124 in the form of a rocker is disposed between the follower 108 and the bracket 38 extending from the downward portion 32 of the mold table 28. The transfer means 124 is secured to the bracket 38 by another leaf spring 126 attached at respective ends to the bracket 38 and the transfer means 124 by fasteners 128 and 130 each associated with a respective plate 132 and 134. The transfer element 124 carries a pair of spaced apart outwardly extending pins 136 each of which locates in a slot formed in plates 138 attached to the mold bracket 38 and the follower 108 in alignment with one another.

The table 94 is rotatably mounted on a turntable 140. The radial position of the table 94 on the turntable 140 is determined by selection means generally indicated in FIG. 6 by numeral 142. The selection means 142 comprises an adjustable tie secured at one end to the table 94 and at the other end to the front wall 42 of the fixed external frame. The tie is in the form of a threaded rod 144 fixed at one end to a bracket 146 attached to the table 94. The threaded rod 144 is received through a pinion 148 having a complementary female thread and whose axial position on the rod 144 is adjusted with a worm 150 attached to a bracket 152 forming part of the front wall 42 of the fixed external frame.

It will be appreciated that adjusting the effective length of the threaded tie rod 144 by means of the worm 150 will vary the radial position of the table 94 along an arc indicated by arrows 154. As a result, the radial position of the wheel 104 or cam on the turntable can be selected. In FIG. 6, alternate positions of the wheel 104 are drawn in ghost-outline and show the wheel either close to the pivot 110 of the follower 108 or remote from the pivot.

Figure 7:
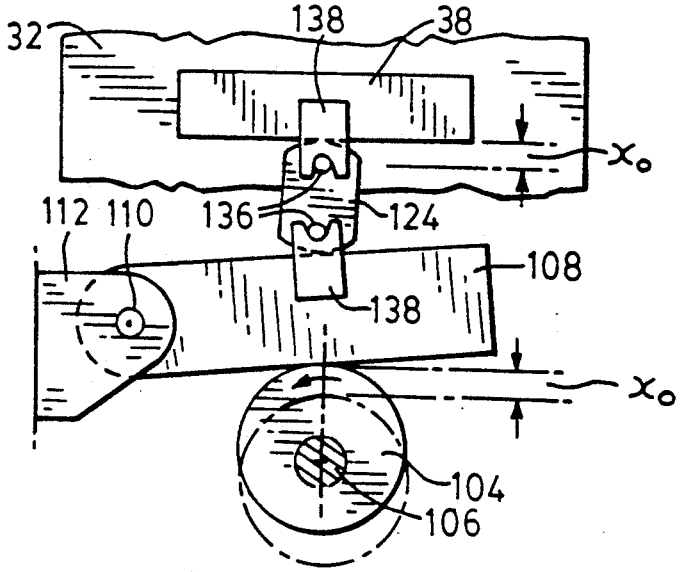
FIGS. 7–9 are schematic views similar to FIG. 5 showing an oscillation drive with cam means in a variety of positions relative to a follower and corresponding to an oscillation stroke of nominal magnitude, a stroke of smaller magnitude, and a stroke of larger magnitude, respectively.
Figure 8:
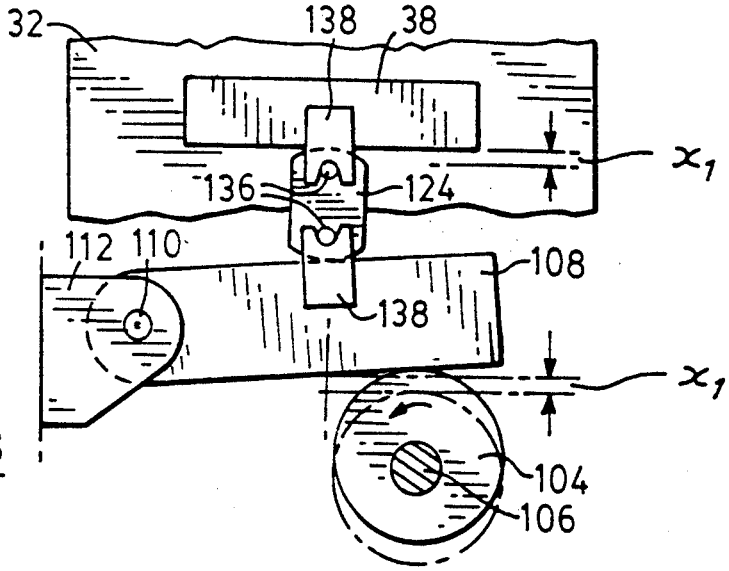
Figure 9:
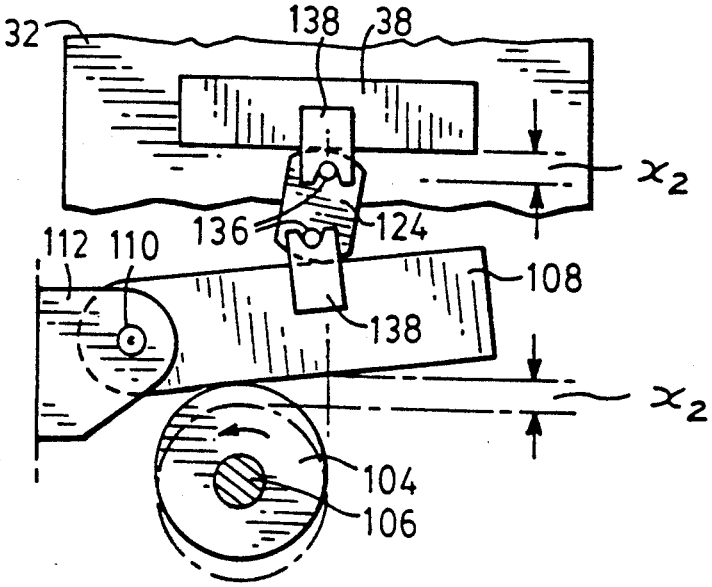

In FIGS. 7 to 9, it is illustrated how the oscillation stroke imparted to the mold will vary according to whether the wheel 104 or cam is positioned in alignment with the transfer means 124 and about midway between the ends of the follower 108 (FIG. 7); spaced from the transfer means 124 and remote from the pivot 110 (FIG. 8); and spaced from the transfer means 124 but near the pivot 110 (FIG. 9). In the neutral position shown in FIG. 7, the follower 108 will travel through a vertical height of magnitude $X_o$ which corresponds to the eccentricity of the wheel 104 and the mold 20 will likewise have an oscillation stroke of magnitude $X_o$. In FIG. 8 where the wheel 104 is remote from the pivot 110, the vertical displacement of the follower 108 at the transfer means 124 has a magnitude $X_1$ which is less than the eccentricity $X_o$ of the wheel 104. The oscillation stroke of the mold likewise has a smaller magnitude $X_1$. In FIG. 9 where the wheel 104 is near the pivot 110, the vertical displacement of the follower 108 at the transfer means 124 has a magnitude $X_2$ which is larger than the eccentricity $X_1$ of the wheel. Similarly, the oscillation stroke of the mold 20 has a greater magnitude $X_2$.

It will thus be understood that the oscillation stroke of the mold may be varied simply by rotation of the table 94 and this is easily accomplished while the continuous casting machine is in operation. This permits the stroke to be adjusted in situ in accordance with the oscillation frequency and casting speed for better control of the surface finish of the cast bar 22.

Figure 10:
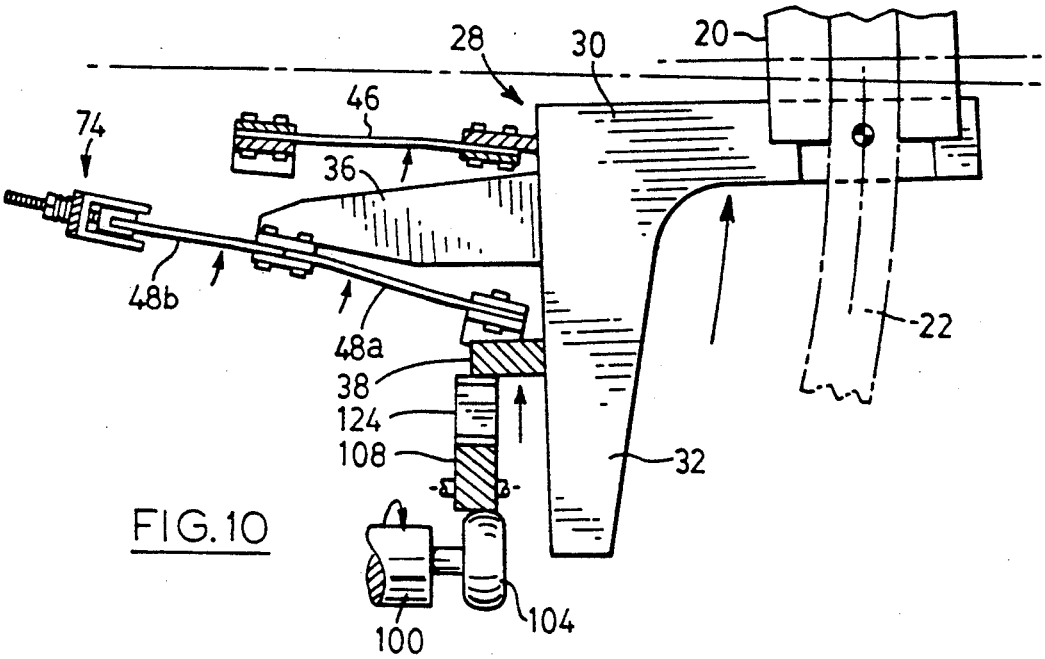
FIGS. 10 and 11 are schematic side elevations similar to FIG. 1 showing the relative displacement of a mold and associated tensile elements during the upward stroke of the oscillating drive and the downward stroke, respectively.

In the upstroke of the follower 108 during oscillation, the mold table 28 is brought to an upwardly inclined position illustrated in FIG. 10. The first tensile element 46 operates to secure the mold table 28 to the fixed external frame and limits the movement of the mold table along a line which is perpendicular to the associated first radius extending from the centre of curvature C. Similarly, the second tensile elements 48, 50 limit movement of the mold table 28 along a line which is perpendicular to the associated second radius extending from the centre of curvature C. The result is that the mold table 28 is guided around the centre of curvature on the casting arc. It will be appreciated that the actual movement about the tensile elements is along an arc defined by the length of the tensile element but since the ratio of the length of the tensile elements to the stroke is in the order of 200 to 1, the deviation from a circular arc of a straight line is negligible and within the expected elastic tolerances of the oscillator.

Figure 11:
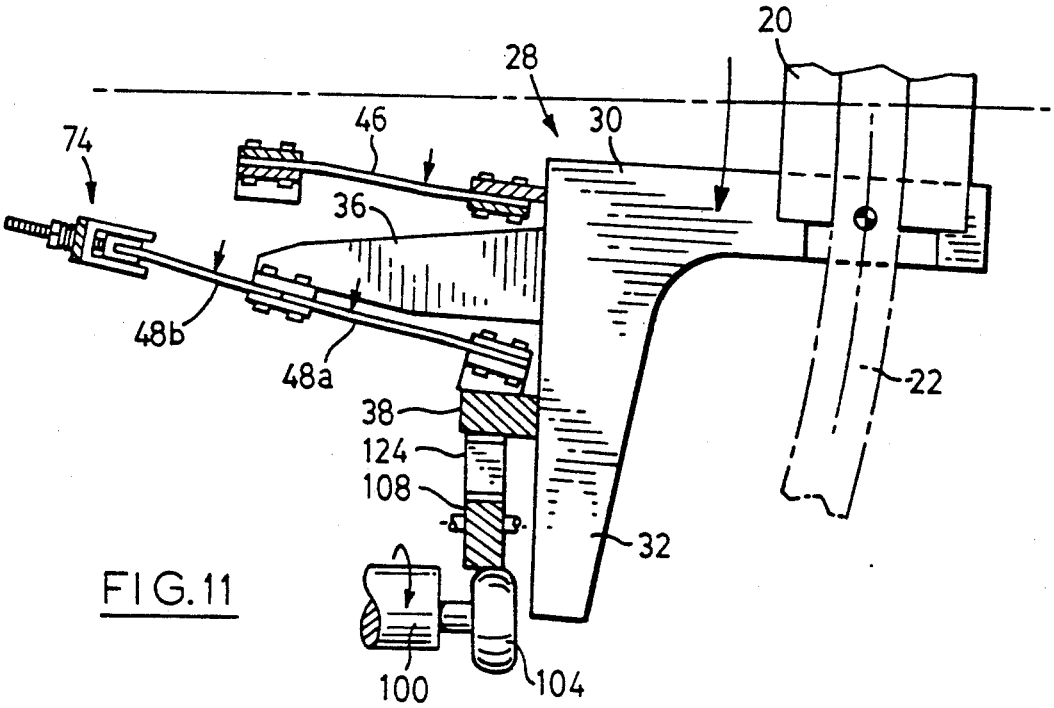

It will be noted that the first tensile element 46 is a sheet which will flex quite easily in a direction transverse to the associated first radius but which will be totally rigid in the orthogonal direction across the width of the mold table 28. This design feature gives the mold table a most important lateral stability. Whether the mold table 28 is in the upwardly inclined position on the upward stroke of the oscillation movement as shown in FIG. 10 or in a downwardly inclined position as shown in FIG. 11 on the downward stroke of the oscillation movement, the first tensile element is always maintained in tension.

The second tensile elements 48, 50 are maintained in tension by applying a preload using the adjustment nut 88. The Belville spring washers 86 operate to change the effective length of the second tensile elements 48, 50 during oscillation. Since the length changes are very small, in the order of 0.005 inches, the length changes in the second tensile elements may in part be accommodated by the elastic behaviour of the spring steel material comprising the elements. It will be appreciated that the prestressed second elements 48, 50 will firmly locate the mold table 28.

An analysis of the mechanical forces operating on the mold table will show a clockwise turning moment (as drawn) defined by the combined mass of the mold 20 and mold table 28. The counterclockwise moment originates in the tensile forces applied to the first and second tensile elements. Because the second tensile elements are anchored at their free ends to the fixed external frame, the connection to the mold table being established intermediate those ends on the mold extensions 36, the second tensile elements 48, 50 are likewise maintained in tension. Any compressive forces applied to the second tensile elements 48 are nullified by prestressing the elements with the tensioning means 74.

Typically, the oscillation stroke achieved will vary between 0.05 inches and 0.5 inches at an oscillation frequency of 400 to 40 cycles per minute respectively and will vary as a function of casting speed.

The invention thus provides an elegantly simple structure for controlling movement of a mold table without any slop because no clearances are required between relatively moving parts. The apparatus is expected to be long lasting and operate maintenance free as long as the tensile elements are used at stress levels which do not exceed their fatigue resistance. It is expected that the load carrying capacity of the mold table will be greatly enhanced because tensile members are employed.

Moreover, the oscillation stroke may be adjusted in situ thereby greatly facilitating the selection of optimium operating conditions.

It will be appreciated that several variations may be made to the above described preferred embodiment of the invention without departing from the scope of the appended claims. As will be apparent to those skilled in the art, the mold guidance means comprising the tensile elements may be associated with a conventional oscillating drive including variety of eccentrically driven means and reciprocating cylinders of various kinds.

In the preferred embodiment described above, an eccentric wheel oscillates a follower pivoted at one end and the distance separating the wheel from the pivoted end is varied by mounting the wheel on a turntable. It will of course be acceptable to move the wheel linearly relative to the follower by mounting it for example on a table supported on rails comprising a rack and pinion.

It will also be appreciated that the oscillating drive may be positioned outside the radius of curvature of the cast product exiting the mold, in which case the tensile elements may be rearranged so as to remain in tension.

I claim:

1. In a continuous casting machine comprising a chilled mold disposed to receive molten metal which is discharged from the mold as a curved casting having a predetermined casting radius, and an oscillating drive for oscillating the mold relative to the casting, wherein the improvement comprises mold guidance means having a first tensile element having an inner end and an outer end, the outer end being anchored to a fixed external frame and the inner end being secured to move with the mold, the first tensile element lying on a first radius extending from the centre of curvature of said predetermined casting radius; and a second tensile element having an inner and an outer end both anchored to a fixed external frame and secured to move with the mold intermediate the inner and outer ends, at least one end having variable tensioning means adapted to apply a tensile force to the second tensile element, the second tensile element lying on a second radius extending from the centre of curvature of said pre-determined casting radius.

2. Apparatus according to claim 1 in which the mold is supported on a mold table and the tensile elements are secured to the mold table.

3. Apparatus according to claim 2 in which the second tensile element is secured between its ends to an arm extension forming part of the mold table.

4. Apparatus according to claim 2 in which the first tensile element comprises a sheet of stainless string steel extending across the width of the mold table.

5. Apparatus according to claim 2 in which the second tensile element is provided in parallel pairs spaced from one another and disposed on the same side of the mold table.

6. Apparatus according to claim 3 in which the second tensile element comprises two lengths of stainless spring steel each having an end anchored to the fixed external frame and of which the other end is attached to a common mount attached to the arm extension forming part of the mold table.

7. Apparatus according to claim 2 in which the oscillating drive comprises drive means driving an eccentrically mounted wheel, a follower pivoted at one end about a pivot on a fixed external frame and disposed to abut on the wheel, a transfer element disposed to maintain contact between the follower and the mold table and selection means adapted to adjust the distance separating the wheel from the pivoted end of the follower so as to vary the oscillation stroke imparted to the mold.

8. An apparatus for oscillating a continuous casting mold supported on a mold table comprising:

a turntable;

drive means mounted on a turntable for rotation with the turntable;

cam means coupled to the drive means and having a predetermined eccentrically;

follower means pivotable at one end about a pivot mounted to a fixed external frame and adapted to maintain physical contact with the cam means;

transfer means disposed to maintain contact between the follower means and the mold table; and adjustment means coupled to the turntable, the adjustment means being adapted to position the turntable for selection of the radial position of the cam means whereby the distance of the cam means from the privoted end of the follower means is modified in accordance with a desired oscillation stroke to be imparted to the mold.

9. An apparatus for oscillating a continuous casting mold supported on a mold table comprising:

drive means rotatably mounted on a turntable;

cam means coupled to the drive means for rotation in a vertical plane and having a predetermined eccentricity;

follower means pivotable at one end about a pivot mounted to a fixed external frame and adapted to maintain physical contact with the cam means;

transfer means disposed to maintain contact between the follower means and the mold table; and a tie secured at one end to the turntable and at the other end to an external frame, the tie being adjustable to select the radial position of the cam means on the turntable and thereby define the distance of the cam means from the pivoted end of the follower means so as to vary the oscillation stroke imparted to the mold.

* * * * *